United States Patent [19]

Jones et al.

[11] Patent Number: 4,702,193

[45] Date of Patent: Oct. 27, 1987

[54] COLLAPSIBLE BOAT

[76] Inventors: Michael P. Jones, R.R. #2, Clarksburg, Ontario, Canada, N0H 1J0; Paul M. Hahn, Ravenna, Ontario, Canada, N0H 2E0

[21] Appl. No.: 878,655

[22] Filed: Jun. 26, 1986

[30] Foreign Application Priority Data

Jun. 27, 1985 [CA] Canada ..... 485534

[51] Int. Cl.[4] ..... B63B 7/00

[52] U.S. Cl. ..... 114/354

[58] Field of Search ..... 114/39, 347, 351, 352, 114/353, 354

[56] References Cited

U.S. PATENT DOCUMENTS

| | | | |
|---|---|---|---|
| 1,359,806 | 11/1920 | Holmstrom | 114/354 |
| 1,649,311 | 11/1927 | Kaechele et al. | 114/354 |
| 2,183,137 | 12/1939 | Fischer | 114/354 |
| 2,415,495 | 2/1947 | Humphreys | 114/354 |
| 2,908,239 | 10/1959 | Laine | 114/39 |

FOREIGN PATENT DOCUMENTS

| | | | |
|---|---|---|---|
| 385834 | 12/1923 | Fed. Rep. of Germany | 114/354 |

*Primary Examiner*—Joseph F. Peters, Jr.
*Assistant Examiner*—Jesûs D. Sotelo

[57] ABSTRACT

The present invention relates to a collapsible boat. The boat is comprised of a flexible water-tight hull-and-deck skin including a deckside cockpit aperture; a bow and forward frame unit for insertion through the aperture toward the bow of the hull-and-deck skin; and a transom and aft frame unit for insertion through the aperture toward the stern of the hull-and-deck skin. A central tensioning unit is provided for insertion through the aperture, the tensioning unit cooperates with the bow and forward frame unit and the transom and aft frame unit so as to simultaneously urge the bow and forward frame unit and the transom and aft unit apart to thereby stretch and tension the hull-and-deck skin. A rigid case assembly is provided for insertion into the aperture and cooperates with the bow and forward frame unit, the transom and aft frame unit and the tensioning unit, the case forming a cockpit for the boat.

30 Claims, 21 Drawing Figures

COLLAPSIBLE BOAT

The present invention relates to portable boats and particularly to a non-inflatable boat that breaks down and fits into a case. This case is used as the cockpit in the assembled boat. The case is small enough to be carried by a person. The boat can be a sailboat and a telescoping mast is designed to fit in the case. One embodiment of the present invention provides an assembled boat which employs a pneumatically expandable transom to provide final tension between the outer skin of the boat and the structurally rigid frame.

This unique combination provides a lightweight boat which is on the one hand very rigid when assembled but on the other hand can fit into a case which can be carried as a suitcase.

The present invention therefore provides a boat which when in its unassembled state can be stored in a small area. The case is sufficiently small to be carried up a flight of stairs and stored in an apartment. As a result, the present invention provides a person living in a busy and congested urban center with the ability to own a boat for sailing while at the same time eliminating the inconvenience of finding expensive storage facilities.

It is therefore an object of the present invention to provide a boat which, when assembled, is rigid so as to be able to sail properly and also to be broken down to fit within a case for easy transportation and storage.

In accordance with an aspect of the invention there is provided a collapsible boat comprising: a flexible water-tight hull-and-deck skin including a deckside cockpit aperture; a bow and forward frame means for insertion through said aperture toward the bow of said hull-and-deck skin; a transom and aft frame means for insertion through said aperture toward the stern of said hull-and-deck skin; a central tensioning means for insertion through said aperture, said tensioning means cooperating with said bow and forward frame means and said transom and aft frame means so as to simultaneously urge said bow and forward frame means forward and said transom and aft means aft to thereby stretch and tension said hull-and-deck skin; and a rigid case assembly for insertion into said aperture and cooperating with said bow and forward frame means, said transom and aft frame means, said tensioning means and said hull-and-deck skin, said case forming a cockpit for said boat.

In the drawings which illustrate embodiments of the invention,

Figure 4:
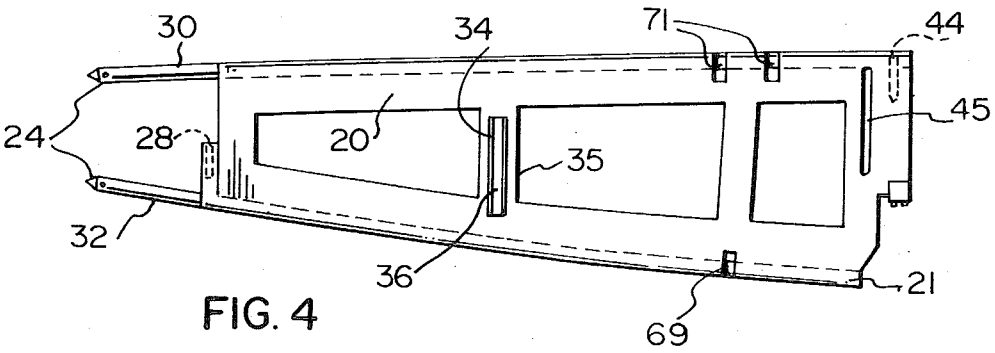
FIG. 4 is a side elevation of a longitudinal center frame member of the boat.
Figure 5B:
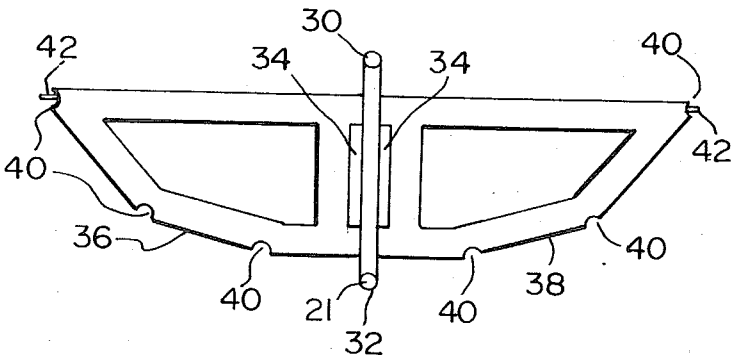
Figure 5A:
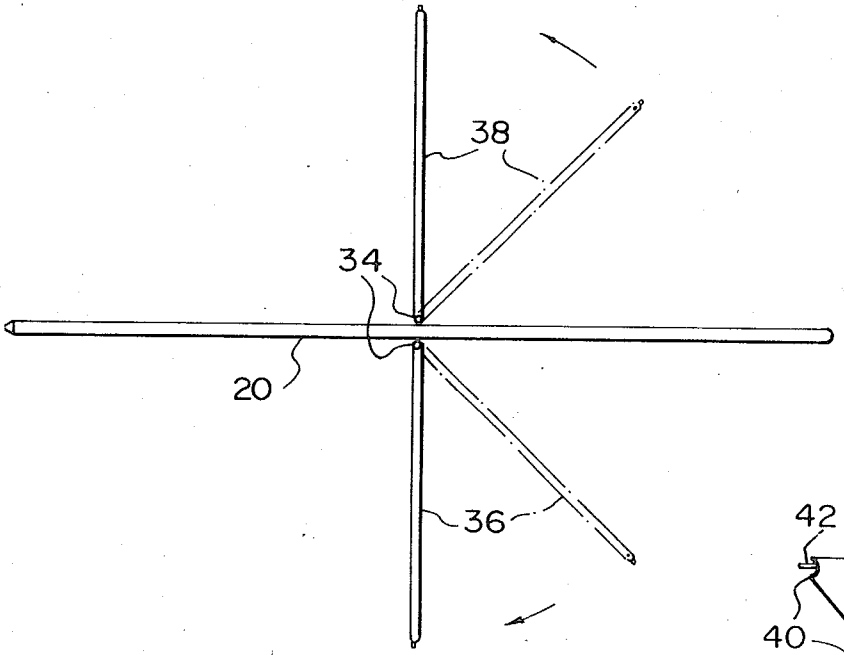

FIG. 5*a* is a top plan view of the frame member of FIG. 4 showing hinged transverse frame members;

FIG. 5*b* is a side elevation of the transverse frame members of FIG. 5*a;*

Figure 2:
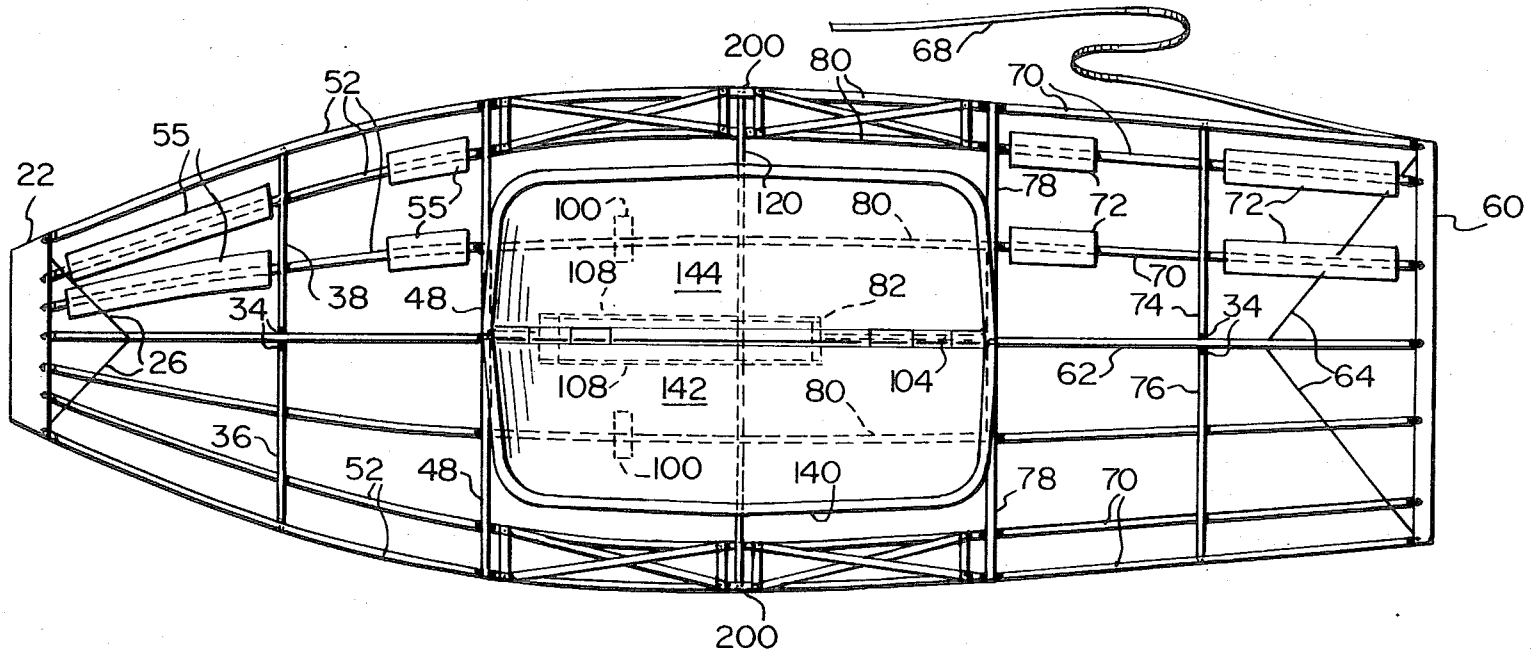
FIG. 2 is a top view of the frame of the boat of FIG. 1 with the flexible skin removed.
Figure 6:
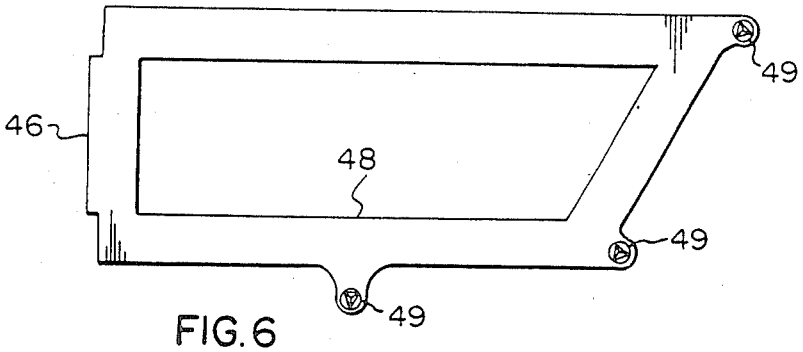
Figure 7:
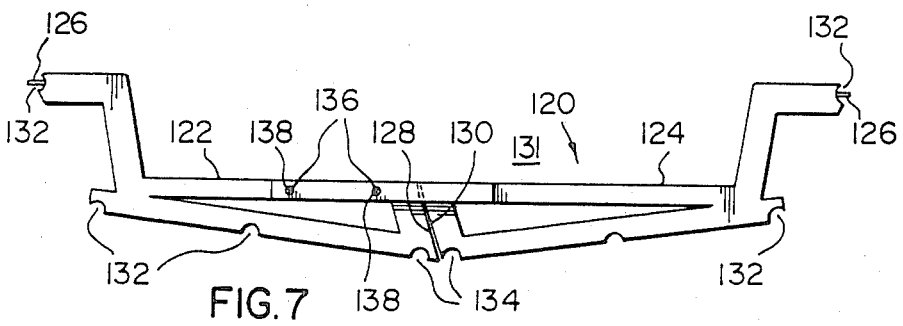
Figure 8A:
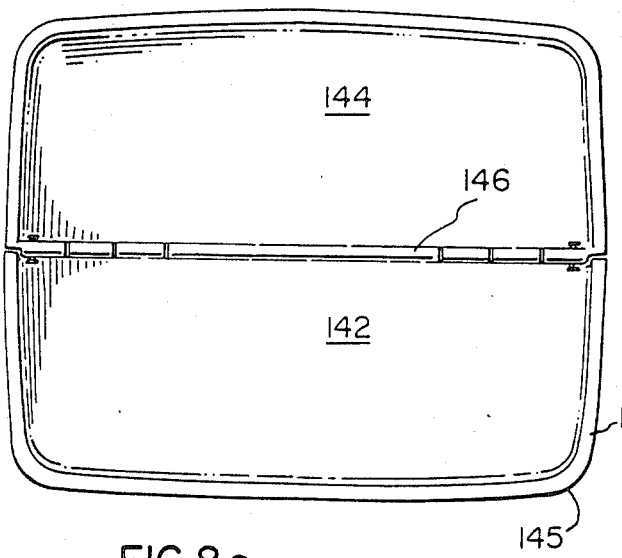
Figure 8B:
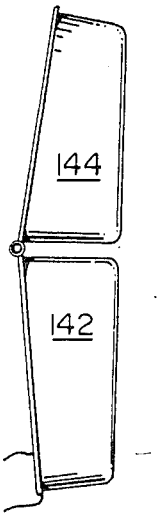
Figure 9A:
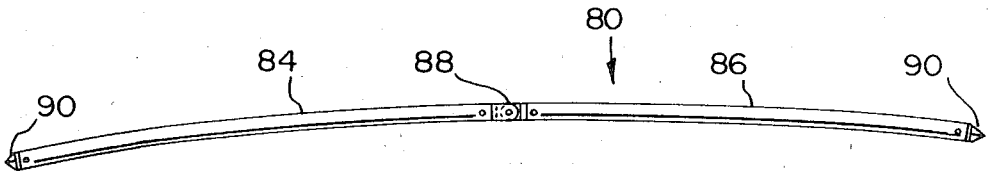
Figure 9B:
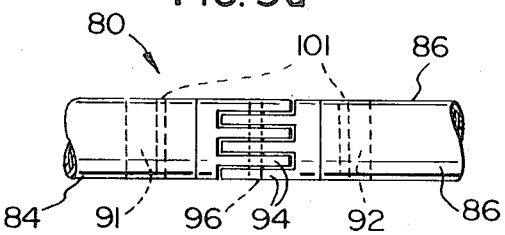

FIG. 6 is a side elevation of one additional transverse frame member of the frame structure of FIG. 2;

FIG. 7 is a side elevation of a middle transverse frame member of the frame structure shown in FIG. 2;

FIGS. 8*a* and 8*b* are top and side views respectively of the carrying case of the boat which also forms the cockpit of the completed boat;

FIG. 9*a* is a side elevation of a typical center primary tensioning tube;

FIG. 9*b* is a detail of the hinge joint of the tube of FIG. 9*a;*

Figure 12:
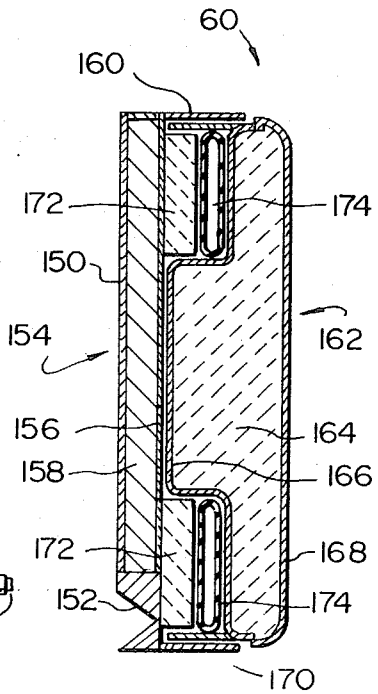
Figure 10A:
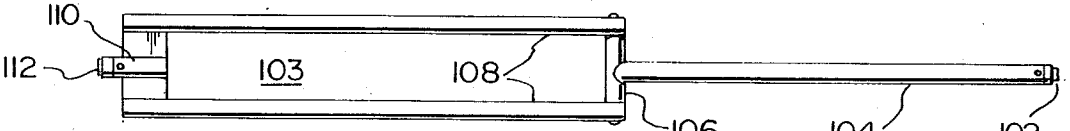
Figure 10B:
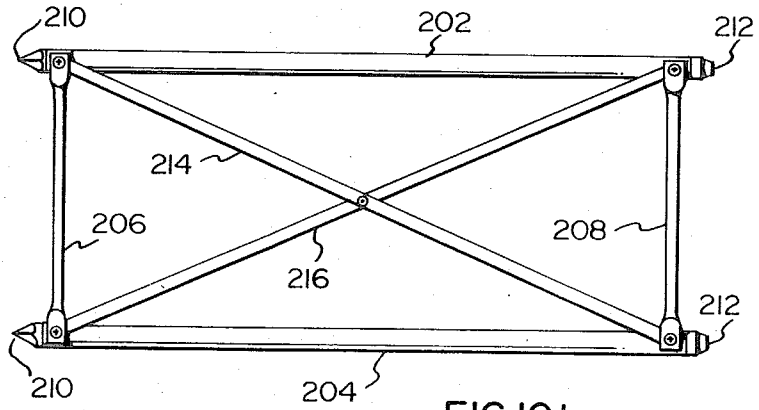
Figure 11:
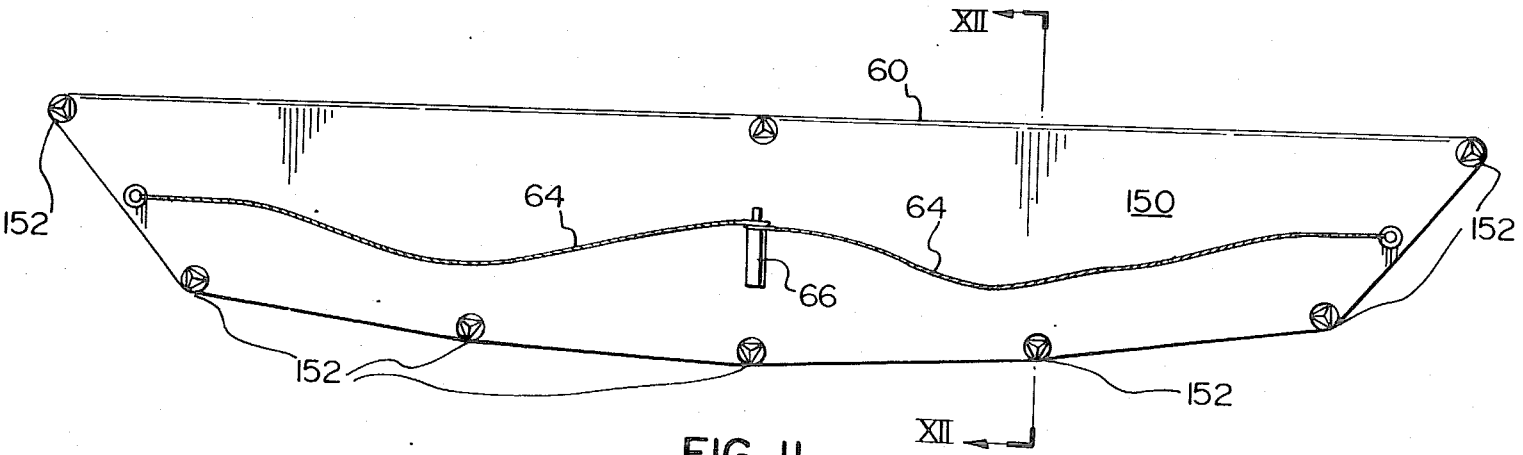

FIG. 10*a* is a top plan view of a central primary tensioning tube of a particular embodiment of the present invention;

FIG. 10*b* is a side elevation of a side tensioning assembly of a particular embodiment of the present invention;

FIG. 11 is a side elevation of the rigid transom;

FIG. 12 (appearing on the same sheet of drawings as FIGS. 9*a* and 9*b*) is a sectional view of the transom taken along lines 12—12 of FIG. 11.

Figure 13:
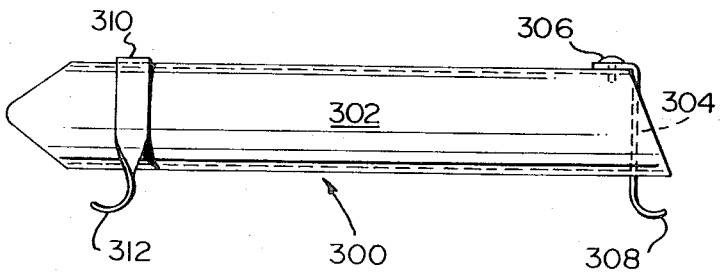
Figure 14:
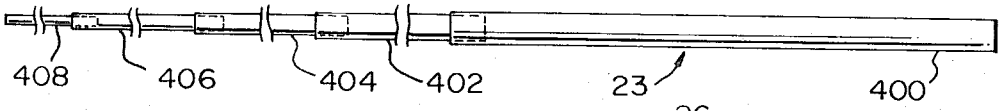
Figure 15:
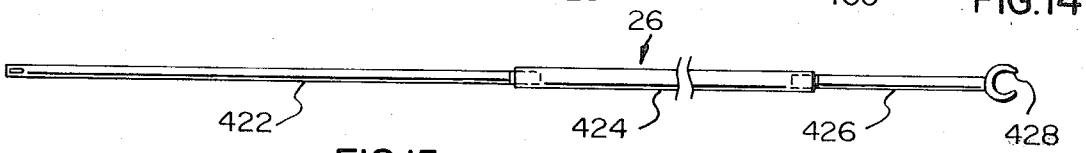
Figure 16:
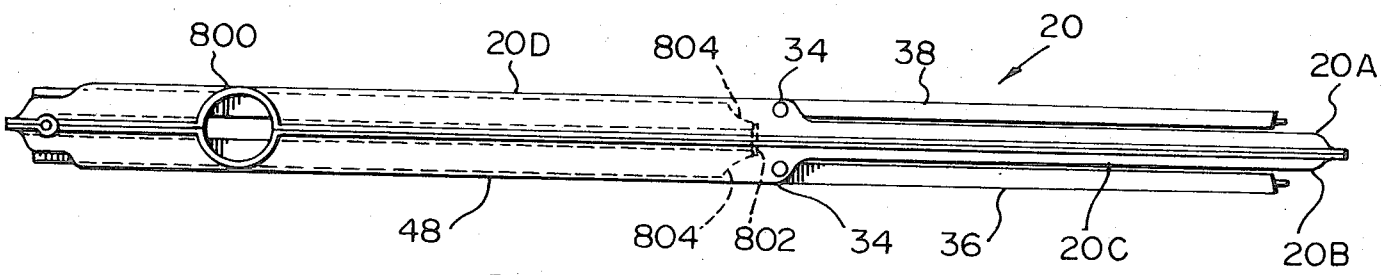
Figure 17:
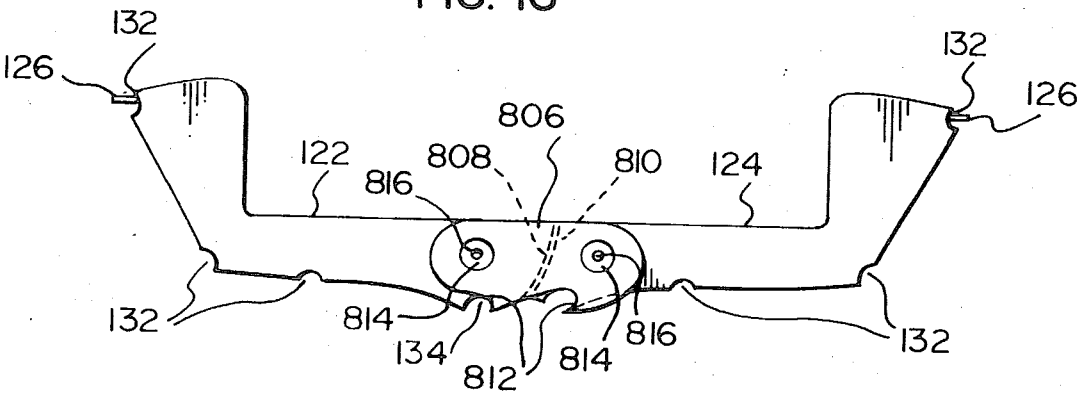

FIG. 13 is a side elevation of a step mast assembly for holding the mast of the sailing embodiment of the present invention, FIG. 14 is a side elevation of a mast of the embodiment of FIG. 13;

FIG. 15 is a side elevation of a boom of the embodiment of FIGS. 13 and 14;

FIG. 16 is a top view of another embodiment of a longitudinal center frame of the boat; and FIG. 17 is a side elevation of another embodiment of a middle transverse frame member of the frame structure shown in FIG. 2.

The hull including deck of the boat are made from a flexible coated fabric. It is important that the coated fabric chosen maintain its shape and size under tension so that the boat will maintain its rigidity over many seasons of use. One preferable fabric is vinyl coated polyester. The hull and the deck fabric or skin are made into a single piece with a large opening located in the central deck area. The opened case, in which all the boat parts are stored, fits into and fills this opening and forms the cockpit. All of the frame sections and metal tubes which lend rigidity to the boat are inserted into this opening and stretch the skin into a tight, rigid hull-and-deck.

Figure 1:
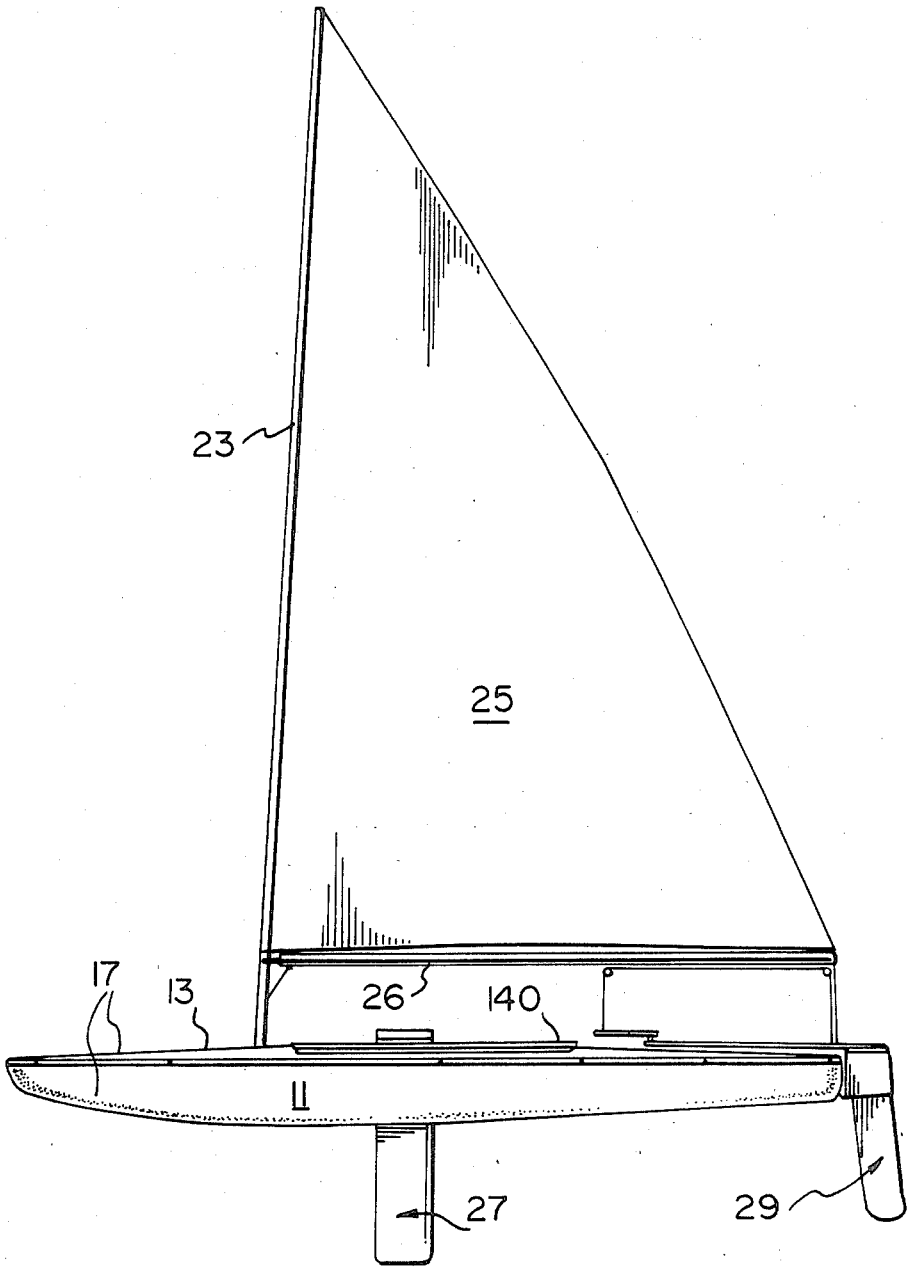
FIG. 1 is a side elevation of a boat according to a particular embodiment of the present invention.

FIG. 1 shows a sailing boat embodiment of the present invention. A hull 11 including a deck 13 are made as a single unit of flexible water-proof skin 17. A mast 23 telescopes within itself and can be stored, in it's collapsed state, in case 140 which also serves as the cockpit for the boat. The mast supports a conventional sail 25. The sail 25 is controlled by a boom 26 which also telescopes so as to fit within case 140 when not in use.

The sailboat version of the present embodiment employs a centerboard 27 which fits through a sleeve in the skin 17. A rudder 29 is provided which also folds to fit within case 140.

Figure 3:
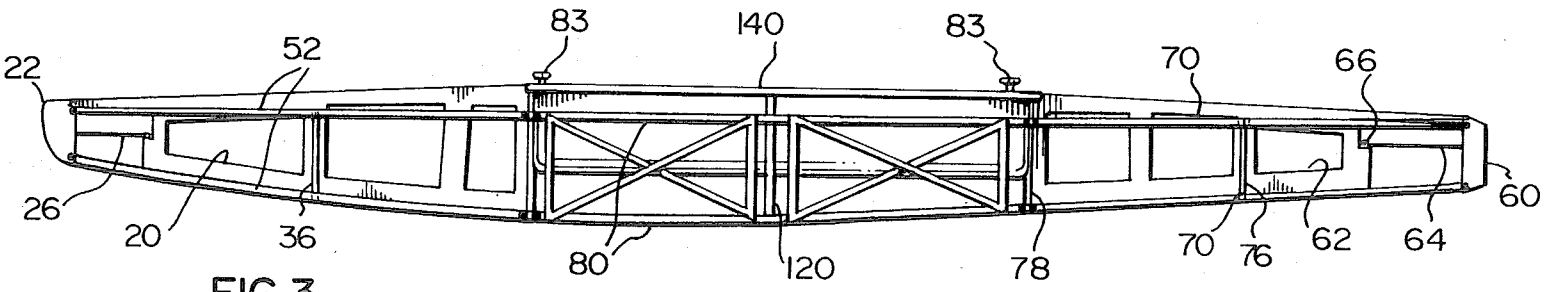
FIG. 3 is a side elevation of the frame of the boat of FIG. 1 with the flexible skin removed.

With reference to FIGS. 2, 3 and 4, a main forward central longitudinal frame member 20 is centrally set against a bow piece 22. Frame member 20 is fitted with points 24 (FIG. 4) which fit into sockets (not shown) in the bow piece 22. The points 24 have a matching shape with the sockets. A typical socket is shown at 49 in FIG. 6. A metal cable 26 is connected to bow piece 22 and terminates in a plug which fits into a hole 28 (FIG. 4). This arrangement connects frame member 20 to bow piece 22. The assembled bow and frame are pushed through the opening in the skin and are shoved to the front of the skin until bow piece 22 comes tightly into contact with the bow end of the skin. The bow piece 22 is rigid and is made of a foam plastic or balsa wood core covered in a layer of fiberglass cloth and resin. The sockets made in the inner surface of the bow piece 22 are triangular in shape to accommodate triangular points 24 located on the frame member 20 and other frame tubes. This shape provides an easy location of the point in the socket and prevents rotation of the tubes.

A detailed view of the main forward longitudinal frame is shown in FIG. 4. Metal tubes 30 and 32 are placed tightly against a foam plastic or balsa wood core and covered by a layer of fiberglass cloth and resin. A box truss configuration is provided which provides a rigid, strong yet light frame assembly. The lower tube 32 is shallowly curved and forms the forward keel shape for the boat. A hinge assembly 34 is located along a substantially central upright strengthening panel 35. A hinged transverse stiffening frame shown in FIGS. 5*a* and 5*b* is connected to the hinge assembly 34. With reference to FIGS. 5*a* and 5*b*, the central element is the main longitudinal frame 20. Transverse stiffening frames 36 and 38 are hinged to frame 20 by hinges 34.

With reference to FIG. 5*b*, transverse frames 36 and 38 are formed of a lightweight foam plastic or balsa wood core and are covered by a layer of glass cloth and resin. Each frame 36 and 38 has a large opening centrally located therein to reduce weight. Each frame 36 and 38 has a plurality of semi-circular indents 40 located along the side and bottom perimeter. These indents 40 accommodate the frame tubes to be described below. Pins 42 are located in the top indent on each frame 36 and 38. The pin 42 locks into a hole provided in appropriate frame tubes.

FIG. 5*a* shows, in phantom, transverse frames 36 and 38 in a partly folded position. For packing into the case, the transverse frames 36 and 38 are folded directly adjacent the longitudinal main frame 20. In the assembled position, as shown in FIG. 5*a*, the transverse stiffening frames 36 and 38 are swung out so that they are substantially perpendicular to the main frame 20. FIG. 2 shows the transverse frames 36 and 38 in their assembled locations.

During assembly, the transverse frames 36 and 38 are swung out to about an angle of 45°. The pins 42 are then inserted in the appropriate holes in the frame tubes and the transverse frames are then moved to a position approximately perpendicular to the main frame 20. The frame tubes are pushed forward at the same time until their points 24 contact the sockets in the bow piece 22. When both the frame tubes and the transverse frames are in position, the pins 42 are locked into postion in the frames tubes.

As can be seen from FIG. 4, the aft end of main frame 20 has a tab fitted thereto. The tab has a threaded portion 44. The case which forms the cockpit is screwed into the main frame 20 at 44 by thumb screw 83, see FIG. 3. A second transverse stiffening frame 48 is connected, on each side of frame 20. The frame 20 has a vertical indent 45 on each side for accommodating each stiffening frame 48.

FIG. 6 shows the second transverse stiffening frame 48 in detail. Once again, the frame is made from a foam plastic or balsa wood core and has a fiberglass and resin cover. Tab 46 located on each frame 48 inserts into each vertical indent 45 in the main longitudinal frame 20. With each tab 46 fitting into indent 45 in the frame 20 the transverse frame 48 holds the skin and the frame tubes in position. The frame tubes will be described in detail below.

Frame 48 has a plurality of sockets 49 located along its side and bottom to accommodate the frame tubes. It should be noted that the sockets 49 are located on both sides of transverse stiffening frame 48.

Referring once again to FIGS. 2 and 3, as was mentioned above, the bow piece 22 is fixed to main longitudinal frame 20 and that assembly is inserted into the front of the skin. Forward frame tubes 52 are already loosely located on the interior of the skin and are held loosely in position by flexible material sheaths 55 bonded onto the inside of the skin. Each frame tube 52 has associated with it two sheaths 55. Once the bow piece and the main forward frame 20 are in place, the six forward frame tubes 52 are pushed forward and seated in the sockets provided in the bow piece 22. The transverse stiffening frames 36 and 38 are then rotated forward, at the same time to allow insertion of pin 42 in the appropriate frame tube, to a point perpendicular to frame 20. The semicircular indents 40 accommodate the frame tubes 52. The upper frame tubes, one on each side of the boat, are known as the gunnel frame tubes and have a hole located at the point where transverse stiffening frames 36 and 38 are in their assembled position. When the transverse frames are at an angle of about 45° pins 42 (FIG. 5*b*) slip into the holes in the gunnel forward frame tubes and lock the frames 36 and 38 into position.

A transom piece 60, to be described in detail below, is similar to bow piece 22. A rear longitudinal main frame 62, similar to frame 20 is connected to the transom piece 60 by cables 64 which are connected to the transom piece 60 and terminate in a plug 66. The plug fits into a hole in the rear frame 62 which is identical to the hole 28 in frame 20 shown in FIG. 4. A long thin strip of skin material 68 is connected to the transom piece 60. Because the transom piece has a width which is similar to the rear portion of the skin, it is difficult to remove the transom piece for disassembly of the boat. The strip 68 can be pulled from the main opening in the deck and since it is connected to one side of the transom piece 60 it tips the transom piece within the skin and allows it to be easily removed.

As with the bow assembly, the transom piece 60 and rear main frame 62 are inserted into the skin opening and pushed into position into the rear of the skin. Next, the rear frame tubes 70 are pushed rearward to engage sockets 152 (see FIG. 11) in the transom piece 60. Once again, pieces of material are bonded onto the inside of the skin to form sheaths 72 to hold the rear frame tubes 70 against transverse movement while allowing longitudinal movement. Hinged transverse stiffening frames 74 and 76 are simultaneously moved from a folded position to an assembled position as shown in FIG. 2. These transverse stiffening frames are similar to the frames 36 and 38 shown in detail in FIGS. 5*a* and 5*b* and will not be described in detail again. As with frames 36 and 38, frames 74 and 76 have pins 42 which engage holes in the gunnel rear frame tubes 70 and thereby lock the frames 74 and 76 into their assembled positions.

A second set of rear transverse stiffening frames 78 are now connected to the rear longitudinal main frame 62. Frames 78 are similar to frames 48 shown in detail in FIG. 6 and will not be described in detail again. The rear frame tubes 70 engage sockets in the frames 78.

The boat is now partially assembled with the bow and stern portions assembled. Primary tensioning tubes 82; 80, and side tensioning assembly 200 are now put into place in the central region of the boat, see FIGS. 2 and 3. These primary tensioning tubes and assemblies are shown in detail in FIGS. 9*a*; 9*b*; 10*a* and 10*b*.

Referring to FIGS. 9*a* and 9*b*, there is shown primary tensioning tube 80. These tubes fit in the middle of the boat and are on the inside floor of the boat immediately on each side of the central or keel tensioning tube 82 shown in FIGS. 2 and 3. Each primary tensioning tube 80 consists of half tubes 84 and 86 connected by a hinge 88. Each distal end of half tubes 84 and 86 is fitted with a triangular point 90. These points 90 will engage in triangular sockets 49 in transverse frames 48 and 78 shown in FIGS. 2 and 3.

FIG. 9*b* shows a typical configuration for the hinge 88. The hinge is made of a pair of plugs 91 and 92 which fit into tubes 84 and 86. The plugs 90 and 92 have their mating ends fashioned into a set of fingers 94, which interconnect and are held together by a pin 96. The plugs are held in tubes 84 and 86 by pins 101.

In operation, the points 90 are set in their associated sockets in frames 48 and 78. The half tubes 84 and 86 are at an oblique angle to one another. The tube 80 is then pressed toward the fabric skin at its center so that the hinge straightens until the half tubes make an angle of 180° with respect to each other. The straightening of these primary tensioning tubes forces the entire forward and rearward frame assemblies apart. This movement stretches the fabric skin into a tight unwrinkled condition. Velcro (trademark) straps 100, see FIG. 2, hold the primary tensioning tubes 80 against the skin and prohibits them from springing into their unassembled configuration.

FIG. 10*a* shows in detail a central or keel tensioning tube 82. As can be seen from FIG. 1, the boat of this particular embodiment is a sailboat and employs a center-board 27. Primary tensioning tube 82 provides a slot 103 for accommodating passage of the centerboard. As can be seen from FIG. 4, main longitudinal forward and rearward frames 20 and 62 each have an aperture 21 in their lower inward ends. This opening merely is the end of metal tube 32. One end of tensioning tube 82 is fitted with a point 102 which fits in aperture 21 in frame 62. Point 102 is situated in the end of a half tube 104. The other end of half tube 104 is connected to a T-tube 106. A pair of half tubes 108 connect in a hinged manner to the distal ends of T-tube 106. Half tubes 108 run parallel to one another and define the opening of slot 103. The opposite ends of half-tubes 108 meet to form a single tube stub 110 and point 112. Point 112 is accommodated in aperture 21 of frame 20. When points 102 and 112 are in apertures 21 of frames 62 and 20, respectively, half tubes 108 meet at an oblique angle with half tube 104. Tubes 108 and 104 are then forced to meet at 180° by pushing downwardly on the T-tube 106. This forces frames 20 and 62 apart and further tensions the skin. A velcro (trademark) strap secures the tensioning tube 82 in place.

As was mentioned above, gunnel frame tubes are located in the fore and aft sections on both side of the boat. There are also frame tubes located directly below the gunnel tubes as both ends of the boat which define the chine of the boat. In the center of the boat, on each side, there are equivalent tubes. However, to add torsional stiffness to the boat these tubes are fastened together into a side tensioning assembly 200. FIG. 10*b* shows one-half of one of the tensioning assemblies 200. The longitudinal sides of the assembly are defined by tubes 202 and 204, tube 202 being a gunnel tube. The tubes are spaced apart by vertical spreader tubes 206 and 208. Tube 206 is located at the forward end of the forward half of assembly 200. Each tube 202 and 204 have their forward ends fitted with points 210 which fit into sockets 49 in frame 46. The opposite end of tubes 202 and 204 are fitted with plugs 212. Diagonal cross braces 214 and 216 are fastened to the ends of tubes 202 and 204 and provide rigidity to the assembly. A similar unit having points at its aft end forms the rest of assembly 200. In the aft structure the plugs 212 do not exist. The points on the aft structure mate with sockets 49 on transverse frames 78. In one embodiment, one of the vertical tubes 208 has been omitted to provide a more compact packing in case 140. In assembly, the points of both halves are set into their respective sockets and the half assemblies meet at an oblique angle inward of the boat's sides. In this way the plugs 212 are inserted into the open ends of the horizontal tubes of the aft half of the assembly. Both halves are pushed outwardly together toward the boat's side and the plugs 212 lock into the tubes.

When constructing the boat, the central of keel tensioning tube 82 is first placed into position. Next, the two side tensioning assemblies 200 are positioned. Finally, the primary tensioning tubes 80 are positioned.

A central transverse stiffening frame 120 is shown in detail in FIG. 7 and is located as shown in FIGS. 2 and 3. This frame consists of two halves 122 and 124. A hole is located in each tube 202 in the aft structure of the tensioning assemblies 200. Pins 126 in frame halves 122 and 124 engage these holes. The frame half 122 is inserted into position. Frame half 124 is then rotated downwardly about pin 126 into a mating postion with frame half 122. The inside facing edges 128 and 130 of half frames 122 and 124, respectively, are curved as shown in FIG. 7 to accommodate frame half 124 swinging into place. Semicircular indents 132 accommodate primary tensioning tubes and the tension assemblies. Semicircular indents 134 accommodate the two half tubes 108 of the primary tensioning tube 82. Once the half frames are pushed into location they are locked together by two pins 136 pushed into through holes 138.

FIG. 7 shows central transverse stiffening frame 120 having a large central rectangular cutout 131 in the top portion thereof. This cutout 131 is necessary to accommodate the case assembly 140.

FIGS. 8*a* and 8*b* show the carrying case 140 into which all of the boat parts can be stored. When case 140 is emptied it is opened as shown in FIG. 8*a* and 8*b* and inserted into the large central hole in the deck skin. Case halves 142 and 144 form the cockpit of the boat as shown in FIGS. 2 and 3. Thumb screws 83 screw through case 140 into threaded holes 44 in front longitudinal frame 20 and rear longitudinal frame 62. The centerboard in the sailboat embodiment, is inserted through aperture 146 between the two halves 142 and 144 of case 140. A sleeve of flexible skin material (not shown) is bonded onto the skin material of the hull at the center keel position. The sleeve extends upwardly through aperture 146 and accommodates the centerboard.

A ridge or lip 145 lends rigidity to the case 140. The skin 17 is tightly fitted around the lip 145. One embodiment (not shown) adds a stiffening element around the lip 145 to further stiffen the structure.

In this condition or stage of assembly the boat is now seaworthy and in a condition to be used. However, under extreme wave conditions it was found that insufficient tension was supplied to the skin and the primary tensioning tubes actually came out of their sockets 49 in transverse stiffening frames 48 and 78. To eliminate this problem an expanding transom was employed. The expanding transom may be seen in FIGS. 11 and 12.

FIG. 11 shows the inner surface 150 of the transom 60. The cable 64 is shown connected to plug 66. Triangular sockets 152 are shown which accommodate the rear frame tubes 70.

FIG. 12 is a sectional view taken along lines XII—XII of FIG. 11 and shows the two-part structure of the transom 60.

The inner portion 154 of the transom includes the inner surface 150, and interior surface 156 surrounding a core 158 and an outer skirt 160. The core 158 is made of a plastic foam or balsa wood material and the outer surface 150 and 154 and the skirt 160 are made of a fiberglass layer and resin.

The outer portion 162 of the transom 60 includes an inner core 164 of foam plastic or balsa wood material with an outer surface of glass cloth and resin. This composite provides a stepped inner surface 166, an outer surface 168 and an interior skirt 170.

A filler block 172 is glued to inner surface 158 of inner portion 154. Mounted between the filler block 172 and the stepped inner surface 166 is an inner tube 174. When the inner tube 174 is inflated to a pressure of, say, 7 psi it expands and moves the outer transom portion away from the inner transom portion so that a sliding movement takes place between outer skirt 160 and inner skirt 170. Since the outer surface 168 of the outer transom portion 162 is in contact with the interior of the flexible skin covering of the boat and since frame tubes 70 are in sockets 152 in the inner transom portion 154, a further beneficial tensioning of the skin takes place. This further tensioning, it has been found, eliminates to a great degree the tendency of the various frame tubes and primary tensioning tubes to break free of their sockets under heavy wave conditions.

A mast step or holder 300 is shown in FIG. 13. The step 300 consists of a tube 302 which has an inside diameter slightly larger than the outside diameter of the largest mast tube to be described below. A bottom clip 304 is centrally located across the bottom of the tube 302 and forms a stop upon which the mast rests. One end is secured to the tube 302 by rivet 306. The other end is shaped into a semi-circular clip 308. Clip 308 fits through a slot 69 (see FIG. 4) cut in main frame 20 and fits around tube 32. Slot 69 need only be large enough to accept the thickness of clip 308. A second bracket 310 connects with tube 302 at it's top end. Clip 310 is U-shaped and has two ends formed into semi-circular clips 312. These clips fit through slots 71 (see FIG. 4) and around tube 30 in the main frame 20. Once in place the mast fits through an aperture in deck skin 17 and into mast step 300. Since the step is connected to the main frame, forces on the mast are transmitted directly to the main frame of the boat.

FIG. 14 shows a five piece telescoping mast 23. It is comprised of five tubes 400, 402, 404, 406 and 408. Tube 400 has the largest diameter and includes sleeves located at one in its interior for accepting tube 402. Tube 402 has a stop ring located near one end on its outside surface. Tube 402 fits into the end of tube 400 contacting the sleeves. The stop ring on tube 402 rests against the end of tube 400. Tube 402 has, at its opposite end, sleeves located in its interior. Tube 404 has a stop located on its outside diameter as described above for tube 402. Tube 404 fits within the sleeved end of tube 402. Tubes 406 and 408 are similar and mate with tubes 404, 402 and 400 in a similar fashion. For storage, the tubes are fitted inside one another by inserting them in the opposite direction so that their various stops bunch together. The forces in a mast increase towards the boat hull. The telescoping design has the advantage that the strongest tubes are located closest to the hull.

FIG. 15 shows a telescoping boom 26. Boom 26 is made of three pieces, two of which telescope. Section 422 fits within section 424 at one end. Similarly, section 426 fits within section 424 at its opposite end. Section 426 is fitted with a C-shaped yoke 428 which connects to mast 23. The thickest and strongest section 424 is the section connecting to the boat.

Section 424 connects with sections 422 and 426 in the same manner as does the mast sections with sleeves on the interior of section 424 and stop rings of exterior of sections 422 and 426. Sections 424 and 422 are the longest and telescope together.

FIG. 16 is another embodiment of the main longitudinal frame shown in FIG. 4. In this embodiment the longitudinal frame is comprised of frame halves 20A and 20B. The frame halves 20A and 20B are connected together by screws (not shown). The assembled main frame 20 forms a narrow forward portion 20C and a wider hollow rearward portion 20D. Transverse frames 36 and 38 are hinged to main frame 20 via hinges 34 as described above with reference to FIG. 5*a*. Transverse frames 36 and 38 fold against the narrow portion 20C of main frame 20 in the packaged configuration. The wider hollow portion 20D of frame 20 houses transverse stiffening frames 48 when in the packed configuration. The rearward end of frame 20 is open and stiffening frames 48 slide out and separate into their transverse, assembled, positions. In this embodiment, the mast holder 30 shown in FIG. 13 is eliminated and an aperture 800 is provided in main frame 20. The mast fits through aperture 800 and sits on a mast step (not shown), located at the bottom of frame 20.

A web 802 connects the inner ends of stiffening frames 48 together. The inner ends of stiffening frames 48 are formed in quarter circular portions 804. In the assembled position of stiffening frames 48, the portions 804 form a semicircular area which accommodates the mast. In this embodiment, the main frame 20 and the stiffening frames 48 directly take the forces imparted by the mast.

FIG. 17 is another embodiment of the middle transverse frame 120 shown in FIG. 7. Frame halves 122 and 124 are connected together by two hinge plates, one of which is shown at 806. The other hinge plate is located on the other side of frame halves 122 and 124 and is identical in mirror image to hinge plate 806. The two hinge plates 806 allow frame halves 122 and 124 to swing into a nested packed configuration (not shown), and into an assembled configuration which is shown. A convex surface 808 of frame halve 122 cooperates with concave surface 810 of frame halve 124. Indents 812 in hinge plates 806 accommodate tubes 82 which are shown in FIG. 10*a*. Each hinge plate 806 has bosses which are indented on one side and protrude on the other side. The indented part of the bosses is shown at 814 in FIG. 17. Frame halves 122 and 124 each has an aperture through which the protruded bosses extend. The ends of the protruding bosses of one hinge plate contacts the ends of the protruding bosses of the other hinge plate through the apertures in the frame halves 122 and 124. Screws 816 connect the two hinge plates together. The length of the bosses is such that the frame halves 122 and 124 pivot about the bosses.

It has been mentioned throughout this disclosure that the frame sections are made of foam plastic or balsa wood cores covered with fiberglass cloth and resin. The invention is not limited to this configuration. Polyethylene molded frame sections are contemplated. When the boat is manufactured in large quantities polyethylene blow molded frame sections will most likely be used.

We claim:

1. A collapsible boat comprising:

a flexible water-tight hull-and-deck skin including a deckside cockpit aperture;

a bow and forward frame means for insertion through said aperture toward the bow of said hull-and-deck skin;

a transom and aft frame means for insertion through said aperture toward the stern of said hull-and-deck skin;

a central tensioning means for insertion through said aperture, said tensioning means cooperating with said bow and forward frame means and said transom and aft frame means so as to simultaneously urge said bow and forward frame means forward and said transom and aft means aft to thereby stretch and tension said hull-and-deck skin; and a rigid case assembly for insertion into said aperture and cooperating with said bow and forward frame means, said transom and aft frame means, said tensioning means and said hull-and-deck skin, said case forming a cockpit for said boat, wherein at least said hull-and-deck skin, said bow and forward frame means, said transom and aft frame means and said central tensioning means disassemble and fit witin said rigid case for storage and transport.

2. The collapsible boat of claim 1, wherein said hull-and-deck skin are made from vinyl coated polyester.

3. The collapsible boat of claim 1 wherein said bow and forward frame means includes:

a rigid bow member having an inner planar surface having a plurality of sockets located therein;

a central rigid longitudinal frame member, having a forward end including points, said points engaging selected sockets of said plurality of sockets in said bow member; and a plurality of forward frame tubes which partly converge forwardly with said longitudinal frame member, each forward frame tube having a point located at each end, each forward frame tube being located directly adjacent said hull skin with the point of one end engaging in a selected socket of said plurality of sockets in said bow member.

4. The collapsible boat of claim 3 wherein said bow and forward frame means further includes a connection means, said connection means comprising a first cable connected at one end to one side of said inner planar surface and at the other end to a plug, and a second cable connected at one end to the other side of said inner planar surface and at the other end to said plug, wherein said plug fits into a hole in said rigid longitudinal frame member, the length of the first cable and the length of the second cable being so dimensioned so as to urge said points on said rigid longitudinal frame member into said selected sockets in said inner planar surface.

5. The collapsible boat of claim 3 wherein said bow and forward frame means further includes first and second rigid transverse stiffening frames, said first transverse stiffening frame being hinged to one side of said central rigid longitudinal frame member and when in its assembled position being substantially perpendicular to said longitudinal frame member and engaging selected forward frame tubes of said plurality of forward frame tubes, said second transverse stiffening frame being hinged to the other side of said central rigid longitudinal frame member directly opposite said first transverse stiffening frame, and wherein, in its assembled position, being substantially perpendicular to said longitudinal frame member and engaging other selected forward frame tubes of said plurality of forward frame tubes.

6. The collapsible boat of claim 5 wherein said bow and forward frame means further includes first and second additional forward rigid transverse stiffening frames each having a forward and aft vertical surface said forward surface having a plurality of forward sockets located therein and said aft surface having a plurality of aft sockets located therein, and wherein said central rigid longitudinal frame member has two vertical indents located adjacent the end opposite said bow member, one indent being located on each side of said central rigid longitudinal frame member and wherein said first additional transverse stiffening frame includes a tab which fits into one of said two vertical indents, said first additional transverse stiffening frame being parallel to said first transverse stiffening frame said forward sockets engaging said points on said selected frame tubes, said points being on the opposite ends of said frame tubes from said bow member, said second additional transverse stiffening frame includes a tab which fits into the other of said two vertical indents, said second additional transverse stiffening frame being parallel to said second transverse stiffening frame, said forward sockets engaging said points on said other selected frame tubes, said other points being located at the opposite ends of said frame tubes from said bow member.

7. The collapsible boat of claim 6 wherein said transom and aft frame means includes:

a rigid transom member having an inner planar surface having a plurality of sockets located therein;

a central aft rigid longitudinal frame member having a rearward end including points, said points engaging selected sockets of said plurality of sockets in said transom member; and a plurality of aft frame tubes located substantially parallel to said aft longitudinal frame member, each aft frame tube having a point located at each end, each aft frame tube being located directly adjacent said skin with the point of each end engaging in a selected socket of said plurality of sockets in said transom member.

8. The collapsible boat of claim 7 wherein said transom and aft frame means further includes first and second transverse stiffening frames, said first transverse stiffening frame being hinged to one side of said aft central rigid longitudinal frame member and when in its assembled position being substantially perpendicular to said aft longitudinal frame member and engaging selected aft frame tubes of said plurality of aft frame tubes, said second transverse stiffening frame being hinged to the other side of said aft central rigid longitudinal frame member directly opposite said first transverse stiffening frame and when in its assembled position being substantially perpendicular to said aft longitudinal frame member and engaging other selected aft frame tubes of said plurality of aft frame tubes.

9. The collapsible boat of claim 8 wherein said transom and aft frame means further includes first and second additional aft rigid transverse stiffening frames each having a forward and aft vertical surface said forward surface having a plurality of forward sockets located therein and said aft surface having a plurality of aft sockets located therein, and wherein said central rigid longitudinal frame member has two vertical indents located adjacent the end opposite said transom member, one indent being located on each side of said central rigid longitudinal frame member and wherein said first additional transverse stiffening frame includes a tab which fits into one of said two vertical indents, said first additional transverse stiffening frame being parallel to said first transverse stiffening frame said aft sockets engaging said points on said selected frame tubes, said points being on the opposite ends of said frame tubes from said transom member, said second additional transverse stiffening frame includes a tab which fits into the other of said two vertical indents, said second additional transverse stiffening frame being parallel to said second transverse stiffening frame said aft sockets engaging said points on said other selected frame tubes, said other points being located at the opposite ends of said frame tubes from said transom member.

10. The collapsible boat of claim 9 wherein said central tensioning means includes:

a plurality of tensioning tubes each having a forward end and an aft end, with each forward and aft end including a point, the points of the forward ends being engagable with selected aft sockets on said first and second additional forward rigid transverse stiffening frames, the points of the aft ends being engagable with selected forward sockets on said first and second additional aft rigid transverse stiffening frames, each plurality of tensioning tubes having a hinge means joining said forward and aft ends wherein said forward and aft ends make an angle of approximately 180° with respect to one another at said hinge means when providing tension.

11. The collapsible boat of claim 10 wherein said central rigid longitudinal frame member includes an aperture at its lower aft end and wherein said central aft rigid longitudinal frame member includes an aperture at its lower forward end and wherein said central tensioning means further includes a central tensioning member having a forward end and an aft end each having a point located thereon for engagement with said aperture in said central rigid longitudinal frame member and said central aft rigid longitudinal frame member, said central tensioning means having a hinge means joining said forward end and said aft end wherein said forward and aft ends make an angle of approximately 180° with respect to one another at said hinge means when providing tension, and wherein said forward end further includes a generally rectangular longitudinal aperture.

12. The collapsible boat of claim 8 wherein said central tensioning means includes a rigid side spreader assembly located on each side of said boat, each said spreader assembly being comprised of a forward section and an aft section, the forward section being comprised of top and bottom longitudinal tubes connected proximate each end to vertical tubes and diagonal bracing means, the forward ends of said top and bottom longitudinal tubes each having a point located therein for engagement with selected aft sockets on said first and second additional forward rigid transverse stiffening frames, the aft section being comprised of top and bottom longitudinal tubes connected proximate each end to diagonal bracing means, at least one vertical tube connecting said top and bottom longitudinal tubes, the aft ends of said top and bottom longitudinal tubes each having a point located therein for engagement with selected forward sockets on said first and second additional aft rigid transverse stiffening frames; and connection means for connecting the forward section to the aft section at the top and bottom longitudinal tubes.

13. The collapsible boat of claim 12 wherein said central tensioning means includes a central transverse stiffening frame cooperating with each tensioning tube of said plurality of tensioning tubes; the central tensioning member and the rigid spreader assembly located on each side of the boat, wherein said central stiffening frame includes first and second halves which cooperate with one another and when assembled are pinned together, said first and second halves each having an upper depression located therein for accepting said case assembly.

14. The collapsible boat of claim 13 wherein said case includes first and second halves joined by hinge means and wherein a generally rectangular longitudinal aperture is located between said first and second halves, said case aperture being in vertical alignment with the aperture in said central tensioning member.

15. The collapsible boat of claim 14 wherein said hull skin has a generally rectangular aperture located therein in alignment with the aperture in said central tensioning member and wherein the aperture in said skin is connected to a sleeve made of flexible skin material said sleeve extending through said aperture in said tensioning member and said aperture in said case to form a vertical tunnel for accepting a centerboard.

16. The collapsible boat of claim 15 wherein said central rigid longitudinal frame member includes slots for accepting a mast step means for holding a mast, said step means including a tube section for engaging said mast and clip means connected to said tube section for insertion into said slots for engagement with said central rigid longitudinal frame member.

17. The collapsible boat of claim 16 further including a telescoping mast having a plurality of sections of decreasing diameter, with each section connecting with its adjacent section to form a mast wherein the section having the largest diameter engages with said mast step means and the section having the smallest diameter is furthest from said mast step means.

18. The collapsible boat of claim 17 further including a sectional boom comprised of a plurality of sections wherein the section of largest diameter is adapted for connection to said boat and wherein one end of said boom connected to said mast.

19. The collapsible boat of claim 13 wherein the first and second halves of said central transverse stiffening frame are connected together by a hinge means.

20. The collapsible boat of claim 19 wherein said hinge means is comprised of first and second hinge plates, said first hinge plate being mounted directly forward and adjacent said transverse stiffening frame and having first and second protruding bosses which rotatably fit within apertures in the first and second halves of said transverse stiffening frame, said second hinge plate being mounted directly rearward and adjacent said transverse stiffening frame and having first and second protruding bosses which rotatably fit within said apertures in the transverse stiffening frame, and fastening means joining said first and second hinge plates together so that the first path of the transverse stiffening frame can move relative to the second path of said transverse stiffening frame.

21. The collapsible boat of claim 20 wherein said fastening means comprises a first fastener that connects together the first bosses of the first and second hinge plates and a second fastener that connects together the second bosses of the first and second hinge plates.

22. The collapsible boat of claim 6 wherein said forward frame means includes first and second frame halves, said frame halves being connected and forming a hollow portion having an aft directed opening, said first and second additional forward rigid transverse stiffening frames, when said boat is in a collapsed state, being stowed within said hollow portion and being accessible via said aft directed opening.

23. The collapsible boat of claim 22 wherein each of said forward rigid transverse stiffening frames has an inner vertical end surface which is curved and wherein said vertical end surfaces are attached by a flexible web.

24. The collapsible boat of claim 22 wherein said forward frame means includes an upper surface, said upper surface including an aperture for accommodating a mast.

25. The collapsible boat of claim 1 wherein said transom and aft frame means includes:

a rigid transom member having an inner planar surface having a plurality of sockets located therein;

a central aft rigid longitudinal frame member having a rearward end including points, said points engaging selected sockets of said plurality of sockets in said transom member; and a plurality of aft frame tubes located substantially parallel to said aft longitudinal frame member, each aft frame tube having a point located at each end, each aft frame tube being located directly adjacent said skin with the point of each end engaging in a selected socket of said plurality of sockets in said transom member.

26. The collapsible boat of claim 25 wherein said transom and aft frame means further includes a connection means, said connection means comprising a first cable connected at one end to one side of said inner planar surface and at the other end to a plug, and a second cable connected at one end to the other side of said inner planar surface and at the other end to said plug, wherein said plug fits into a hole in said aft rigid longitudinal frame member, the length of said first cable and said second cable being so dimensioned as to urge said points on said aft rigid longitudinal frame member into said selected sockets in said inner planar surface.

27. The collapsible boat of claim 25 wherein said transom and aft frame means further includes first and second transverse stiffening frame, said first transverse stiffening frame being hinged to one side of said aft central rigid longitudinal frame member and when in its assembled position being substantially perpendicular to said aft longitudinal frame member and engaging selected aft frame tubes of said plurality of aft frame tubes, said second transverse stiffening frame being hinged to the other side of said aft central rigid longitudinal frame member directly opposite said first transverse stiffening frame and when in its assembled position being substantially perpendicular to said aft longitudinal frame member and engaging other selected aft frame tubes of said plurality aft frame tubes.

28. The collapsible boat of claim 27 wherein said transom and aft frame means further includes first and second additional aft rigid transverse stiffening frames each having a forward and aft vertical surface said forward surface having a plurality of forward sockets located therein and said aft surface having a plurality of aft sockets located therein, and wherein said central rigid longitudinal frame member has two vertical indents located adjacent the end opposite said transom member, one indent being located on each side of said central rigid longitudinal frame member and wherein said first additional transverse stiffening frame includes a tab which fits into one of said two vertical indents, said first additional transverse stiffening frame being parallel to said first transverse stiffening frame said aft sockets engaging said points on said selected frame tubes, said points being on the opposite ends of said frame tubes from said transom member, said second additional transverse stiffening frame includes a tab which fits into the other of said two vertical indents, said second additional transverse stiffening frame being parallel to said second transverse stiffening frame said aft sockets engaging said points on said other selected frame tubes, said other points being located at the opposite ends of said frame tubes from said transom member.

29. The collapsible boat of claim 1 wherein said transom and aft frame means includes a transom member, said transom member including a forward rigid element and an aft rigid element, said forward element engaging a central aft rigid longitudinal frame member, said aft element engaging the hull skin, an expandable pneumatic means sandwiched between said forward element and said aft element wherein, when said expandable pneumatic means is inflated said forward element and said aft element are moved apart thereby placing tension between said central aft rigid longitudinal frame member and said hull skin to thereby tighten the hull-and-deck skin.

30. The collapsible boat of claim 29 wherein said forward element includes an outer rigid skirt about its perimeter and wherein said aft element includes an inner rigid skirt about its perimeter, said inner skirt and said outer skirt sliding on one another during the inflation of said pneumatic means.

* * * * *